US011111727B2

(12) United States Patent
Al Obaid et al.

(10) Patent No.: US 11,111,727 B2
(45) Date of Patent: Sep. 7, 2021

(54) HIGH-POWER LASER DRILLING SYSTEM

(71) Applicant: Saudi Arabian Oil Company, Dhahran (SA)

(72) Inventors: Omar Mohammed Al Obaid, Dhahran (SA); Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 191 days.

(21) Appl. No.: 16/439,391

(22) Filed: Jun. 12, 2019

(65) Prior Publication Data

US 2020/0392794 A1 Dec. 17, 2020

(51) Int. Cl.

| | |
|---|---|
| ***E21B 47/00*** | (2012.01) |
| ***E21B 7/15*** | (2006.01) |
| *E21B 17/10* | (2006.01) |
| *E21B 37/00* | (2006.01) |

(52) U.S. Cl.

CPC ..... *E21B 7/15* (2013.01); *E21B 47/00* (2013.01); *E21B 17/1078* (2013.01); *E21B 37/00* (2013.01)

(58) Field of Classification Search

CPC ..... E21B 7/15; E21B 17/1078; E21B 37/00; E21B 43/11; E21B 43/26; E21B 47/00

See application file for complete search history.

(56) References Cited

U.S. PATENT DOCUMENTS

| | | | | |
|---|---|---|---|---|
| 3,871,485 A | | 3/1975 | Keenan, Jr. | |
| 4,282,940 A | * | 8/1981 | Salisbury | B26F 1/31 175/11 |
| 4,997,250 A | | 3/1991 | Ortiz, Jr. | |

(Continued)

FOREIGN PATENT DOCUMENTS

| | | |
|---|---|---|
| EP | 1015166 B1 | 6/2003 |
| EP | 1629935 A1 | 3/2006 |

(Continued)

OTHER PUBLICATIONS

International Search Report for PCT/IB2019/056775, 4 pages (dated Mar. 9, 2020).

(Continued)

*Primary Examiner* — Daniel P Stephenson
(74) *Attorney, Agent, or Firm* — Choate, Hall & Stewart LLP; Charles E. Lyon; Peter A. Flynn

(57) ABSTRACT

The present disclosure relates to systems and methods for drilling a hole(s) in a subsurface formation utilizing laser energy that is controlled by an optical manipulation system. Various embodiments of the disclosed systems and methods use a laser with a laser source (generator) located on the surface with the power conveyed via fiber optic cables down the wellbore to a downhole target via a laser tool. The optical manipulation system provides the flexibility to control and manipulate the beams, resulting in an optimized optical design with fewer optical components and less mechanical motion. Different beam shapes can be achieved by the different optical lenses and designs disclosed in this specification. Additionally, a purging system is disclosed that is configured to clear a path of the laser beam, assist in manipulating the tool, or both. The rotating and purging features contribute to creating a clean hole with no melt.

19 Claims, 5 Drawing Sheets

(56) References Cited

U.S. PATENT DOCUMENTS

| | | | | |
|---|---|---|---|---|
| 5,409,376 | A | 4/1995 | Murphy | |
| 6,355,907 | B1 | 3/2002 | Kuehnle et al. | |
| 6,362,454 | B1 | 3/2002 | Liu | |
| 6,538,230 | B2 | 3/2003 | Lawson | |
| 6,755,262 | B2 | 6/2004 | Parker | |
| 6,849,824 | B2 | 2/2005 | Arai et al. | |
| 6,880,646 | B2 | 4/2005 | Batarseh | |
| 6,888,097 | B2 * | 5/2005 | Batarseh | B23K 26/0648 219/121.7 |
| 7,214,904 | B2 | 5/2007 | Zeltner | |
| 7,487,834 | B2 | 2/2009 | Reed et al. | |
| 8,627,901 | B1 | 1/2014 | Underwood et al. | |
| 8,826,973 | B2 | 9/2014 | Moxley et al. | |
| 9,217,291 | B2 | 12/2015 | Batarseh | |
| 9,512,679 | B2 | 12/2016 | Rinzler et al. | |
| 9,903,171 | B2 * | 2/2018 | Linetskiy | E21B 43/17 |
| 10,273,787 | B2 * | 4/2019 | Montaron | E21B 29/06 |
| 2004/0206505 | A1 | 10/2004 | Batarseh | |
| 2005/0263497 | A1 | 12/2005 | Lehane et al. | |
| 2006/0102343 | A1 * | 5/2006 | Skinner | G01N 21/718 166/250.1 |
| 2006/0114311 | A1 | 6/2006 | Chen | |
| 2010/0044104 | A1 | 2/2010 | Zediker et al. | |
| 2011/0198087 | A1 * | 8/2011 | Adam | E21B 7/18 166/308.1 |
| 2012/0074110 | A1 | 3/2012 | Zediker et al. | |
| 2013/0008659 | A1 | 1/2013 | Schultz et al. | |
| 2013/0175243 | A1 | 7/2013 | Wang | |
| 2013/0228372 | A1 * | 9/2013 | Linyaev | E21B 7/15 175/16 |
| 2013/0228557 | A1 * | 9/2013 | Zediker | B23K 26/1462 219/121.61 |
| 2014/0060930 | A1 | 3/2014 | Zediker et al. | |
| 2014/0182933 | A1 | 7/2014 | Skinner et al. | |
| 2014/0360778 | A1 | 12/2014 | Batarseh | |
| 2015/0308194 | A1 | 10/2015 | Moxley et al. | |
| 2016/0273325 | A1 | 9/2016 | Montaron | |
| 2016/0312587 | A1 | 10/2016 | Montaron et al. | |
| 2017/0285351 | A9 | 10/2017 | Salama et al. | |
| 2017/0321486 | A1 | 11/2017 | Faircloth et al. | |
| 2018/0003001 | A1 | 1/2018 | Pipchuk et al. | |
| 2018/0223653 | A1 | 8/2018 | Stark et al. | |
| 2020/0392794 | A1 * | 12/2020 | Al Obaid | E21B 7/15 |

FOREIGN PATENT DOCUMENTS

| | | | |
|---|---|---|---|
| JP | 2007237231 | A | 9/2007 |
| WO | WO-91/018703 | A1 | 12/1991 |
| WO | WO-99/063793 | A1 | 12/1999 |
| WO | WO-2020/250022 | A1 | 12/2020 |

OTHER PUBLICATIONS

Wang, P., Beam-shaping optics delivers high-power beams, Laser Focus World, 37(12): 5 pages (Dec. 2001).

Written Opinion for PCT/IB2019/056775, 9 pages (dated Mar. 9, 2020).

* cited by examiner

HIGH-POWER LASER DRILLING SYSTEM

TECHNICAL FIELD

This application relates to systems and methods for stimulating hydrocarbon bearing formations using high-power lasers.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and into the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits on the penetration depth and diameter of the tunnels. There is a risk involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

High power laser systems can also be used in a downhole application for stimulating the formation via, for example, laser drilling a clean, controlled hole. Laser drilling typically saves time, because laser drilling does not require pipe connections like conventional drilling, and is a more environmentally friendly technology with far fewer emissions, as the laser is electrically powered. However, there are still limitations regarding the placement and maneuverability of a laser tool for effective downhole use.

SUMMARY

Conventional methods for drilling holes in a formation have been consistent in the use of mechanical force by rotating a bit. Problems with this method include damage to the formation, damage to the bit, and the difficulty to steer the drilling assembly with greater accuracy. Moreover, drilling through a hard formation has proven very difficult, slow, and expensive. However, the current state of the art in laser technology can be used to tackle these challenges. Generally, because a laser provides thermal input, it will break the bonds and cementation between particles and simply push them out of the way. Drilling through a hard formation will be easier and faster, in part, because the disclosed methods and systems will eliminate the need to pull out of the wellbore to replace the drill bit after wearing out and can go through any formation regardless of its compressive strength.

The present disclosure relates to new systems and methods for drilling a hole(s) in a subsurface formation utilizing high power laser energy that is controlled by an optical manipulation system. In particular, various embodiments of the disclosed systems and methods use a high powered laser(s) with a laser source (generator) located on the surface, typically in the vicinity of a wellbore, with the power conveyed via fiber optic cables down the wellbore to a downhole target via a laser tool. The disclosed innovative optical manipulation system provides the flexibility to control and manipulate the beams, resulting in an optimized optical design with fewer optical components and less mechanical motion. Different beam shapes can be achieved by the different optical lenses and designs disclosed in this specification. The shape of the beam can be configured from circular to rectangular to cover more area and rotated via a rotating tool head. Additionally, a novel inclined purging system is disclosed that is configured to clear a path of the laser beam, assist in manipulating the tool, or both. The rotating and purging features contribute to creating a clean hole with no melt.

Generally, the disclosed downhole laser system for penetrating a hydrocarbon bearing formation includes a laser generating unit configured to generate a high power laser beam. The laser generating unit is in electrical communication with a fiber optic cable. The fiber optic cable is configured to conduct the high power laser beam. The fiber optic cable includes an insulation cable configured to resist high temperature and high pressure, a protective laser fiber cable configured to conduct the high power laser beam, a laser surface end configured to receive the high power laser beam, a laser cable end configured to emit a raw laser beam from the fiber optic cable. In some embodiment, the system includes an optional outer casing or housing placed within an existing wellbore that extends within a hydrocarbon bearing formation to further protect the fiber optic cable(s), power lines, or fluid lines that make up the laser tool.

In one example, the system includes a laser tool configured for downhole movement. The laser tool includes an optical assembly configured to shape a laser beam for output. The laser beam may have an optical power of at least one kilowatt (1 kW). A housing at least partially contains the optical assembly. The housing is configured for movement to direct the output laser beam within the wellbore. The movement includes vertical movement and rotational movement relative to a longitudinal axis of the wellbore. A control system is configured to control at least one of the movement of the housing or an operation of the optical assembly to direct the output laser beam within the wellbore.

The shaping performed by the optical assembly may include focusing the laser beam, collimating the laser beam, or spreading the laser beam. The optical assembly may include a first lens in a path of the laser beam and a second lens in the path of the laser beam. The second lens is downstream from the first lens in the path of the laser beam. The first lens may be a focusing lens to focus the laser beam. The second lens may be a collimating lens to receive the laser beam from the focusing lens and to collimate the laser beam. The second lens may be a diverging lens to receive the laser beam from the focusing lens and to cause the laser beam to spread. An adjustment mechanism is configurable to change a distance between the first lens and the second lens. The adjustment mechanism may include an adjustable rod to move the first lens along the path of the laser beam via the a linear or rotary actuator, for example, a servo motor or manually operated screw mechanism. The adjustment mechanism may be controlled by the control system. The optical assembly may also include means for further directing the laser, for example, changing a path of the laser beam. The directing means may be downstream from the first and second lenses in the path of the laser beam and include at least one of a mirror, a beam splitter, or a prism. In some embodiments, the directing means includes at least two triangular prisms and an adjustment mechanism that is configurable to change a distance between the first prism and the second prism. The adjustment mechanism may be the same mechanism previously described and also be controlled by the control system. Additionally, spacers or other electro-mechanical devices can be used to adjust the distances between components.

In one aspect, the application relates to a system for stimulating a hydrocarbon-bearing formation. The system includes a laser tool configured to operate within a wellbore of the formation. The tool includes one or more optical transmission media, the one or more optical transmission media being part of an optical path originating at a laser generating unit configured to generate a raw laser beam. The one or more optical transmission media is coupled to an optical assembly and configured for passing the raw laser beam to the optical assembly. The optical assembly is configured to shape a laser beam for output. The tool also includes a rotational system coupled to the optical assembly and configured for rotating the laser beam about a central axis of the optical assembly and a housing that contains at least a portion of the optical assembly, where the housing is configured for movement within the wellbore to direct the laser beam relative to the wellbore. The tool can also include a purging assembly disposed at least partially within or adjacent to the housing and configured for delivering a purging fluid to an area proximate the laser beam and a control system to control at least one of the movement of the housing or an operation of the optical assembly to direct the laser beam within the wellbore.

In various embodiments, the optical assembly includes: a collimator, first and second lenses, and first and second triangular prisms. The collimator is coupled to the one or more optical transmission media and configured for receiving and conditioning the raw laser beam into a collimated beam. The first lens is disposed downstream of the collimator and configured for conditioning the collimated beam and outputting an elongated oval laser beam. The second lens is disposed a distance downstream of the first lens and configured for receiving and collimating the oval laser beam. The first triangular prism is disposed downstream of the second lens and configured for receiving and bending the collimated oval laser beam. The second triangular prism is disposed a distance downstream of the first triangular prism and configured for receiving and correcting the bent collimated oval laser beam to output a substantially rectangular beam offset from a central axis of the optical assembly.

In some embodiments, the distance between the first and second triangular prisms is adjustable, the distance between the first and second lenses is adjustable, or both distances are adjustable. The tool can include one or more adjustment mechanisms that can change the distance between the first and second triangular prisms or the first and second lenses, or both. The adjustment mechanism can be controlled by the control system. In some embodiments, at least one of the first or second lenses is a plano-concave lens; however, other lens shapes and configurations are contemplated and can be chosen to suit a particular application.

In additional embodiments, the rotational system is disposed upstream of the optical assembly and proximate or at least partially within the housing. The rotational system is configured to rotate the optical assembly about the central axis. In some embodiments, the rotational system is part of the purging system. The rotational/purging system can include a generally cylindrical housing coupling a first portion and a second portion of the housing and defining at least one opening about a circumference of the circular housing. Alternatively, the rotational/purging system can include a generally cylindrical housing coupled to a first end of the housing and defining at least one opening about a circumference of the circular housing.

The rotational/purging system can also include a plurality of fins disposed at least partially within the at least one opening and spaced about the circumference of the circular housing and at least one nozzle disposed within the circular housing. The at least one nozzle can be oriented offset from the central axis of the optical assembly and configured to discharge a purging fluid at an angle towards the fins to cause rotational motion of the second portion of the housing. Alternatively or additionally, the at least one nozzle disposed within the circular housing can be oriented at an incline from the central axis of the optical assembly. The rotational system can also include a cover and at least one seal to isolate an internal space of the rotational assembly from a downhole environment of the wellbore.

In some embodiments, the system can also include one or more sensors to monitor one or more environmental conditions in the wellbore and to output signals based on the one or more environmental conditions to the control system. The system can also include one or more centralizers attached to the housing and configured to hold the tool in place relative to an outer casing in a wellbore.

In another aspect, the application relates to a method of using a system for stimulating a hydrocarbon-bearing formation. The method includes the steps of: passing, through one or more optical transmission media, a raw laser beam generated by a laser generating unit at an origin of an optical path including the optical transmission media; delivering the raw laser beam to an optical assembly positioned within a wellbore; manipulating the raw laser beam with the optical assembly to output a substantially rectangular beam offset from a central axis of the optical assembly; and rotating the optical assembly about the central axis. Rotation of the optical assembly will result in rotation of the offset beam, thereby delivering the substantially rectangular beam to the formation to drill a substantially circular hole in the formation. A diameter of the resulting hole will be greater than a diameter of the raw laser beam.

In various embodiments, the method includes the step of purging a path of the rotated laser beam with a purging nozzle during a period of a drilling operation. The method can also include the step of vacuuming any dust, vapor, or other debris generated during the drilling operation.

In some embodiments, the step of manipulating the raw laser beam with the optical assembly includes collimating the raw laser beam to create a collimated laser beam, passing the collimated laser beam through a first lens to output an elongated oval laser beam, passing the elongated oval laser beam through a second lens for collimating the elongated oval laser beam, passing the collimated oval laser beam through a first triangular prism to bend the oval laser beam relative to the central axis of the optical assembly, and passing the bent laser beam through a second triangular prism. This last step will correct and output a substantially rectangular beam offset from the central axis of the optical assembly.

In various embodiments, the step of manipulating the raw laser beam includes adjusting a distance between the first and second triangular prisms to modify a distance the laser beam is offset from the central axis of the optical assembly, adjusting a distance between the first and second lenses to adjust a thickness of the collimated oval laser beam, or both.

The method may include such other steps as monitoring, using one or more sensors, one or more environmental conditions in the wellbore during operation of the tool and outputting signals based on the one or more environmental conditions.

DEFINITIONS

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

Figure 1:
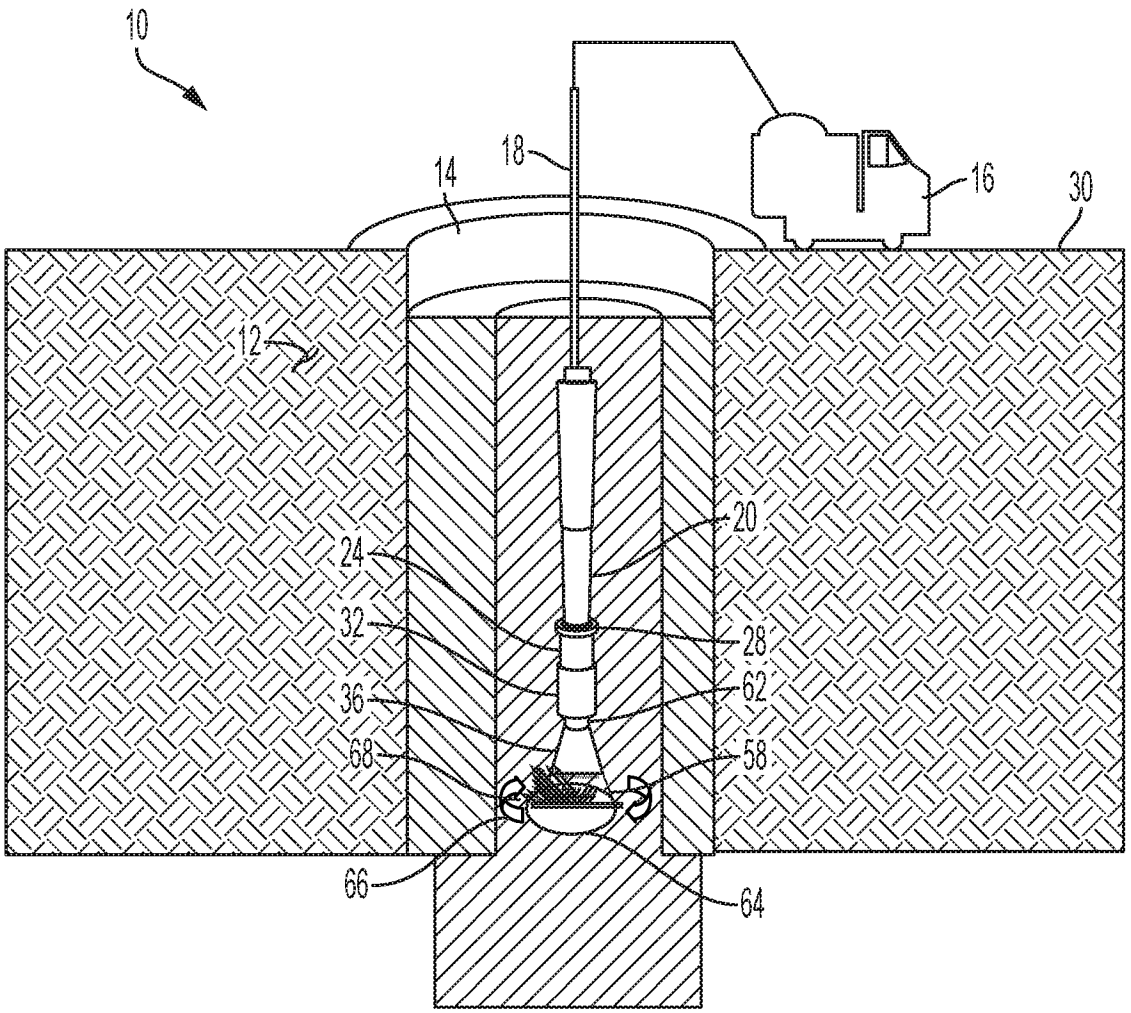
FIG. 1 is a schematic representation of a downhole high-power laser drilling and purging system and related methods in accordance with one or more embodiments.

FIG. 1 depicts one embodiment of a downhole high-power laser drilling and purging system 10 and related methods for stimulating a formation 12. The system 10 includes a laser source 16 and a laser tool assembly 20 in communication with the laser source 16 via a cable assembly 18. The laser source 16 is located on the surface 30 in the vicinity of the wellbore 14 and is configured to provide: the means to position and manipulate the tool assembly 20 within the wellbore 14; the controls and fluid (gas or liquid) source for a purging assembly 26; and the controls and means for delivering laser energy to an optical assembly 24. The cable assembly 18 provides the tool assembly 20 with power (electric) and includes optical transmission media, such as optical fibers, for transmitting the laser energy to the tool 20. The cable 18 is encased for protection from the downhole environment, where the cable casing can be made of any commercially available materials to protect the cable 18 from high temperature, high pressure, and fluid/gas/particle invasion of the cable 18.

Figure 2:
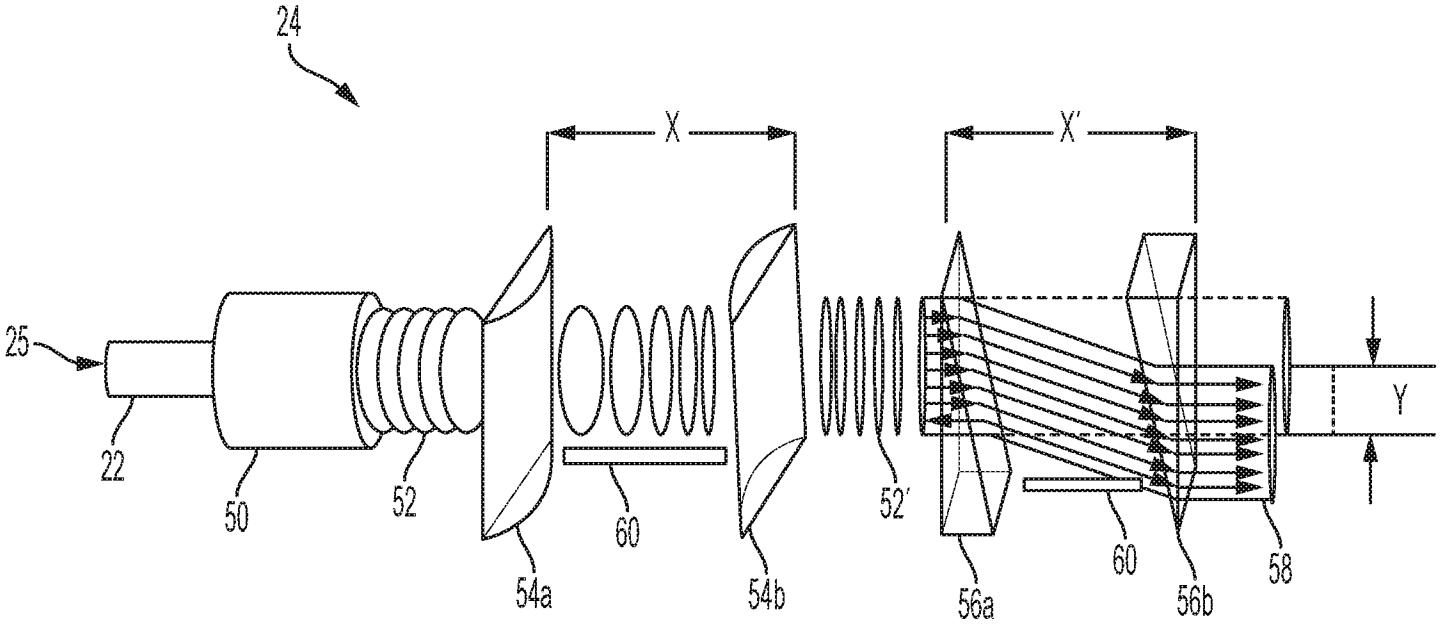
FIG. 2 is an enlarged and exploded schematic representation of an optical manipulation system and related methods in accordance with one or more embodiments.

The laser tool 20 includes the optical assembly 24, which includes the various optical components, such as lenses, prisms, and a collimator and is described in greater detail with respect to FIG. 2. The purging assembly 26, which also includes at least a portion of the rotational system 28, includes one or more nozzles as is described in greater detail with respect to FIG. 3.

FIG. 2 depicts an exploded view of the optical assembly 24 for manipulating the raw laser beam 25 generated by the laser source 16. Generally, the raw laser beam 25 generated from the surface 30 will travel through the optical transmission media 22 within the cable assembly 18, exiting into the optical assembly 24. As shown, the optical assembly 24 includes a collimator 50 coupled to the optical transmission media 22 for receiving the raw laser beam 25 and outputting a collimated beam 52 with a desired diameter. The collimated beam 52 is then passed to a pair of plano-concave lenses 54*a*, 54*b* and a pair of triangular prisms 56*a*, 56*b*; however, other types of lenses and prisms are contemplated and considered within the scope of the disclosed systems and methods. The collimated beam 52 will travel to the first plano-concave lens 54*a* and will start shrinking in one axis after phasing through the first plano-concave lens 54*a*, turning the shape of the beam 52 into an elongated oval. The second plano-concave lens 54*b* will collimate the elongated oval shape beam. A distance (X) between the two plano-concave lenses 54*a*, 54*b* is adjustable and will determine the thickness of the beam shape, thus controlling the intensity of the beam.

The shaped, collimated beam 52' travels to the first triangular prism 56*a* and is bent downward and directed towards the second triangular prism 56*b*, which will correct the bend, achieving a desired offset beam 58. A distance (X') between the triangular prisms 56*a*, 56*b* is also adjustable, and by controlling the distance between the prisms, an offset distance (Y) can be controlled. In some embodiments, the beam is offset to avoid overlapping the motion of the beam during rotation, thus, having better control over the thermal input to the formation. The optical assembly 24 can include one or more adjustment mechanisms 60 as previously described. In some cases, the prisms, lenses, or both can be coupled to a motorized axis that is electrically driven as part of the adjustment mechanism. Generally, the X, X', and Y dimensions will vary to suit a particular application, taking into account the size of the wellbore, the size of the tool, the size of raw laser beam delivered via the fiber optics, the output beam size needed, and the orientation of the tool within the wellbore. For example, if the tool is perpendicular to the hole, the motion is restricted to the wellbore diameter. For example, for a hole with a 7 inch diameter, the X, X' and Y should move within less than 7 inches. However, if the tool is disposed in a long wellbore, parallel to the wellbore, then the vertical distance to move is much larger and the X, X', and Y can be in the range of about 1 inch to 12 inches.

In some embodiments, the housing 32 for the optical assembly can include a cover lens 62 to protect the optical assembly 24, for example, by preventing dust and vapor from entering the tool housing 32. The various optical components previously described can be any material, for example, glass, plastic, quartz, crystal or other material capable of withstanding the environmental conditions to which they are subjected. The shapes and curvatures of any lenses can be determined by one of skill in the art based on the application of downhole laser system 10.

Figure 3:
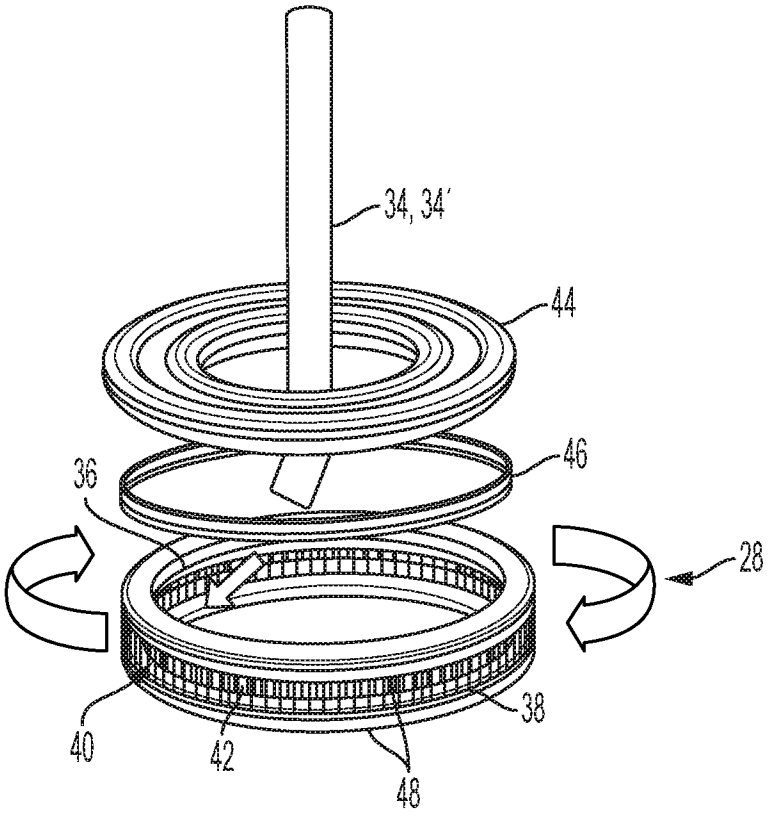
FIG. 3 is an enlarged and exploded schematic representation of a portion of a purging system and related methods in accordance with one or more embodiments.

A portion of the purging assembly 26 including the rotational system 28 is depicted in FIG. 3 and includes one or more nozzles 34 for delivering a flow of a purging medium (gas or liquid) 36 to an area of the wellbore 14 proximate the offset laser beam 58. In some embodiments, the laser tool 20 can also include one or more vacuum nozzles 34'. The purging nozzles 34 may emit any purging media 36 capable of clearing dust and vapor from the front of the tool 20. Purging media can include any gas, such as air or nitrogen, or a liquid, such as a water or oil-based mud. Generally, the choice of purging media 36, between a liquid or a gas, can be based on the rock type of the hydrocarbon bearing formation 12 and the reservoir pressure. The purging media 36 should allow the laser beam 58 to reach the hydrocarbon bearing formation 12 with minimal or no loss. In some embodiments, the purging media 36 can be a non-reactive, non-damaging gas such as nitrogen. A gas purging media may also be appropriate when there is a low reservoir pressure. In various embodiments, the purging nozzles 34 may operate in cycles of on periods and off periods. An on period may occur while the laser beam 58 is discharging as controlled by an on period of the laser generating unit 16. In some embodiments the purging nozzles 34 can operate in a continuous mode.

Vacuum nozzles 34', if included, can aspirate or vacuum dust or vapor, for example, dust or vapor created by the sublimation of the hydrocarbon bearing formation 12 by the laser beam 58. The dust or vapor can be removed to the surface and analyzed. Analysis of dust or vapor can include determination of, for example, rock type of the hydrocarbon bearing formation 12, or fluid type contained within the formation 12. In some embodiments, the dust or vapor can be disposed of at the surface 30. One of skill in the art will appreciate that vacuum nozzles 34' can include one, two, three, four, or more nozzles depending, for example, on the quantity of dust and vapor. The size of vacuum nozzles 34' may depend on the volume of dust or vapor to be removed and the physical requirements of the system. In some embodiments, the vacuum nozzles 34' can operate in cycles of on periods and off periods. On periods may occur while the laser beam 58 and purging nozzles 34 are not operating, as controlled by the laser generating unit 16. The off periods of the laser beam 58 and purging nozzles 34 may allow the vacuum nozzles to clear a path, so that the laser beam 58 has an unobstructed path from the tool 20 to the formation 12. In some embodiments, the vacuum nozzles 34' can operate in a continuous mode; however, the vacuum nozzles 34' would not operate when the purging nozzles 34 emit a liquid purging media 36.

As previously disclosed, the purging assembly 26 also includes the rotational system 28. The rotational system 28 includes a circular housing 38 disposed at one end of the tool housing 32 or at an intermediate point of the tool housing, dividing the tool housing 32 into first and second portions. The rotational system 28 is disposed upstream of the optical assembly 24 so as to allow the optical assembly 24 to rotate relative to the rest of the system 10.

In at least one embodiment, the circular housing 38 includes at least one opening or groove 40 disposed along a circumference of the housing 38. The rotational system 28 also includes at least one fin 42 disposed within the opening 40 or otherwise adjacent to the housing 38. In various embodiments, there is a plurality of fins 42 spaced about the circumference of the housing 38. The fins 42 may be spaced evenly about the circumference of the housing 38 or arranged in a set pattern to suit a particular application. The rotational system 32 may also include an optional cover(s) 44 and seal(s) 46 as necessary to protect the internal workings of the tool 20 from the downhole environment. The cover 44 and seal 46 may also assist in directing the flow of the purging medium 36.

Generally, the rotational system 32 is designed to rotate by the flow of the purging media 36 supplied by the one or more nozzles 34 through the housing 38. In some embodiments, the housing 38 may be made up of one or more interconnected circular rings 48 whose spacing define the groove(s) 40. In various embodiments, the fins 42 can be machined into the circular housing 38. When the purging medium 36 reaches the groove(s) 40, it causes rotation of the optical assembly, and by extension the offset laser beam 58. The purging nozzle(s) is aimed at an angle, also referred to as inclined, to the tool to cause rotation in one direction.

Referring back to FIG. 1, the cable 18 connects the laser energy to the downhole tool 20, including the optical assembly 24 and the rotational system 28. The optical assembly 24 converts the raw, circular laser beam 25 into the straight line, also referred to as rectangular, beam 58. The rotational system 28 causes the beam 58 to rotate and generate a circular shape 66, the beam rotates along with the purging system 24, which is inclined at an angle to the tool to create an inclined purging flow 68 to remove the debris proximate the laser beam 58. The rotating laser beam 58 creates a circular pattern to create a hole 64. The diameter of the beam can range from about 2 inches to 12 inches, depending on the tool size and the space within the wellbore to move the tool. The tool 20 can be further manipulated for vertical or horizontal drilling and rock penetration. The tool can be deployed to a depth of about 5,000 feet to 10,000 feet, and in some embodiments even deeper depending on the various conditions. Generally, the laser beam 58 will introduce thermal input (heat) to the formation, weakening and breaking the bonds and cementation between the particles, and then ejecting those particles using the purge assembly 26. The purge fluid 36 will be transparent to the laser beam wavelength. Those skilled in the art will appreciate the need to eliminate dust and debris in the path of the laser beam 58 due to the potential to disrupt, bend, or scatter the laser beam 58.

In general, the construction materials of the downhole laser tool system 10 can be of any types of materials that are resistant to the high temperatures, pressures, and vibrations that may be experienced within an existing wellbore 14, and that can protect the system from fluids, dust, and debris. One of ordinary skill in the art will be familiar with suitable materials.

The laser generating unit 16 can excite energy to a level greater than a sublimation point of the hydrocarbon bearing formation 12, which is output as the raw laser beam 25. The excitation energy of the laser beam required to sublimate the hydrocarbon bearing formation 12 can be determined by one of skill in the art. In some embodiments, laser generating unit 16 can be tuned to excite energy to different levels as required for different hydrocarbon bearing formations 12. The hydrocarbon bearing formation 12 can include limestone, shale, sandstone, or other rock types common in hydrocarbon bearing formations. The fiber optics 22 disposed within the cable 18 will conduct the laser beam 25, passing the raw laser beam through the rotational system 28 and the optical assembly 24 to output the offset laser beam 58. The discharged laser beam 58 can penetrate a wellbore casing, cement, and hydrocarbon bearing formation 12 to form, for example, holes or tunnels.

The laser generating unit 16 can be any type of laser unit capable of generating high power laser beams, which can be conducted through fiber optic cable 22, such as, for example, lasers of ytterbium, erbium, neodymium, dysprosium, praseodymium, and thulium ions. In some embodiments, the laser generating unit 16 includes, for example, a 5.34-kW Ytterbium-doped multi-clad fiber laser. In some embodiments, the laser generating unit 16 can be any type of laser capable of delivering a laser at a minimum loss. The wavelength of the laser generating unit 16 can be determined by one of skill in the art as necessary to penetrate hydrocarbon bearing formations.

In some embodiments, the laser generating unit 16 operates in a run mode until a desired penetration depth is reached. A run mode can be defined by, for example, a cycling mode or a continuous mode. A duration of a run mode can be based on the type of hydrocarbon bearing formation 12 and the desired penetration depth. A hydrocarbon bearing formation 12 that would require a run mode in a cycling mode includes, for example, sandstones with high quartz content, such as Berea sandstone. Hydrocarbon bearing formations 12 that require a run mode in a continuous mode include, for example, limestone. Desired penetration depth can be a desired tunnel depth, tunnel length, or tunnel diameter. Desired penetration depth is determined by the application and hydrocarbon bearing formation 12 qualities such as, geological material or rock type, target diameter of the tunnel, rock maximum horizontal stress, or the compressive strength of the rock. In some embodiments, the downhole laser system 10 can be used for deep penetration into hydrocarbon bearing formations. Deep penetration can encompass any penetration depth beyond six (6) inches into the hydrocarbon bearing formation 12, and can include depths of one, two, three or more feet.

In some embodiments, when a run mode constitutes a cycling mode, the laser generating unit cycles between on periods and off periods to, for example, avoid overheating one or more components of the downhole laser system 10 and to clear the path of the laser beam 58. Cycling in this context includes switching back and forth between an on period, when the laser generating unit 16 generates a high power laser beam, and an off period, when the laser generating unit 16 does not generate a high power laser beam. The duration of an on period can be the same as a duration of the off period, can be longer than the duration of the off period, can be shorter than the duration of the off period, or can be any combination. The duration of each on period and each off period can be determined from the desired penetration depth, by experimentation, or by both. In some embodiments, the laser generating unit 16 is programmable, such that a computer program operates to cycle the laser source 16.

Other factors that contribute to the duration of on periods and off periods include, for example, rock type, purging methods, beam diameter, and laser power. In some embodiments, experiments on a representative of a rock type of the hydrocarbon bearing formation 12 could be conducted prior to lowering the laser tool 20 into the existing wellbore 14. See, for example, FIGS. 4 and 5. Such experiments could be conducted to determine optimal duration of each on period and each off period. In some embodiments, on periods and off periods can last one to five seconds. In some specific embodiments, a laser beam penetrates a hydrocarbon bearing formation of Berea sandstone, in which an on period lasts for four (4) seconds and an off period lasts for four (4) seconds and the resulting penetration depth will be about twelve (12) inches.

In some embodiments, a run mode is a continuous mode. In continuous mode, the laser generating unit 16 stays in an on period until the desired penetration depth is reached. In some embodiments, a duration of the run mode is defined by the duration of the continuous mode. The laser generating unit 16 can be of a type that is expected to operate for many hours before needing maintenance. The particular rock type of the hydrocarbon bearing formation 12 can be determined by experiment, by geological methods, or by analyzing samples taken from the hydrocarbon bearing formation 12.

The laser system 10 can also include a motion system that lowers the tool 20 to a desired elevation within the wellbore 14. In various embodiments, the motion system can be in electrical or optical communication with the laser generating unit 16; such that the motion system can relay its elevation within the wellbore 14 to the laser generating unit 16 and can receive an elevation target from the laser generating unit 16. The motion system can move the tool 20 up or down to a desired elevation and can include, for example, a hydraulic system, an electrical system, or a motor operated system to drive the tool 20 into a desired location. In some embodiments, controls for the motion system are included as part of the laser generating unit 16. In some embodiments, the laser generating unit 16 can be programmed to control placement of the tool 20 based only on a specified elevation target and a position target. In some embodiments, the tool 20 can receive an elevation target from the laser generating unit 16 and move to the elevation target.

In various embodiments, the laser system 10, in particular, the tool 20 can include one or more sensors to monitor one or more environmental conditions in the wellbore 14 or one or more conditions of the downhole tool 20 to, for example, monitor temperature in the wellbore 14, a surface temperature of the tool 20, mechanical stress in a wall of the wellbore 14, mechanical stress on the tool 20, flow of fluids in wellbore 14, presence of debris in the wellbore 14, the pressure in the wellbore 14, or radiation, magnetic fields. In some embodiments, the sensor(s) can be a fiber optic sensor, for example, a fiber optic thermal sensor. In some embodiments, the sensor(s) can be an acoustic sensor.

Additionally, in various embodiments, the tool 20 can include one or more centralizers to maintain a desired position of the tool 20 inside the wellbore 14. A centralizer can be metal, polymer, or any other suitable material. One of ordinary skill in the art will be familiar with suitable materials. In some embodiments, the centralizer can include a spring or a damper, or both. In some embodiments, the centralizer includes a solid piece of a deformable material, for example, a polymer or a swellable packer. In some embodiments, the centralizer is or includes a hydraulic or pneumatic device.

Figure 4:
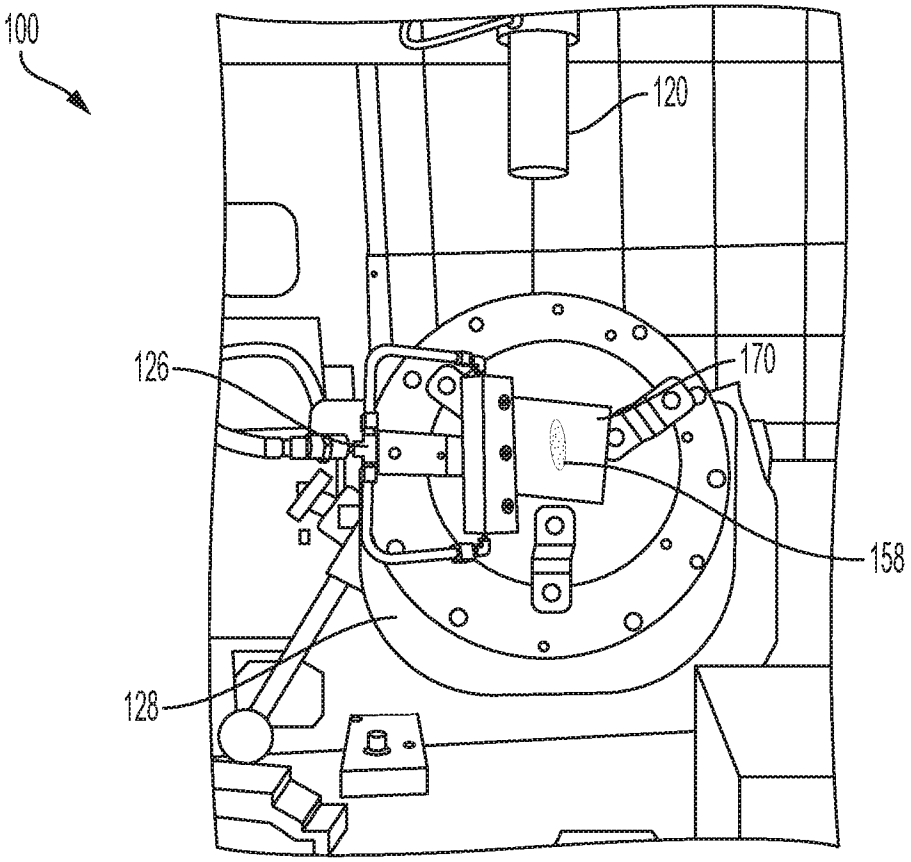
FIG. 4 is a pictorial representation of a set-up of a downhole high-power laser drilling and purging system in accordance with one or more embodiments.

FIG. 4 depicts an exemplary set-up of a downhole laser system 100. The laser system 100 depicted in FIG. 4 is a special laboratory set up to mimic the conditions in the field and uses an optical rotational table and incline angle to apply the same principle of operation. As shown, the laser source is provided by a laser head 120 delivering the manipulated laser beam to a rock sample 170. Also shown is a purge system 126 disposed at an angle to the sample 170, where the angle provides the flow of gas or fluid at an angle so the debris is ejected away from the laser beam. If the debris is ejected in the same path as the laser beam, the debris will absorb the energy causing less energy to be delivered to the formation, which results in less drilling.

Figure 5:
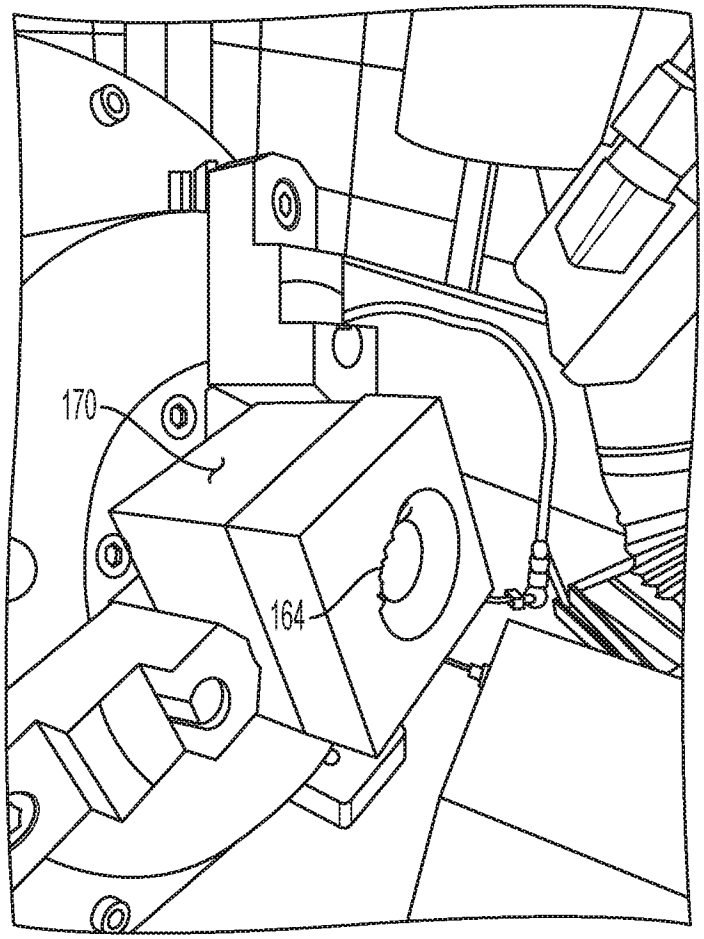
FIG. 5 is a pictorial representation of a result of the set-up of FIG. 4 in accordance with one or more embodiments.

The sample 170 is mounted on a rotational table 128 to provide rotation of the sample 170 relative to the elongated beam 158, with the rotation and purging on simultaneously. The laser energy used in this case is about 2 kW, rotation is about 3 RPM, and the time of the experiment was about 120 seconds. FIG. 5 depicts the results (hole 164) of the inclined purging and elongated beam drilling in a sandstone formation in accordance with one embodiment of the disclosed system. The same principle can be applied for all other applications and formation types disclosed herein.

At least part of the laser system 10 and its various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain action is immaterial so long as the described method remains operable. Moreover, two or more steps or actions may be conducted simultaneously.

What is claimed:

1. A system for stimulating a hydrocarbon-bearing formation, the system comprising:

a laser tool configured to operate within a wellbore of the formation, the tool comprising:

one or more optical transmission media, the one or more optical transmission media being part of an optical path originating at a laser generating unit configured to generate a raw laser beam, the one or more optical transmission media configured for passing the raw laser beam;

an optical assembly coupled to the optical transmission media and configured to shape a laser beam for output, the optical assembly comprising a collimator coupled to the one or more optical transmission media and configured for receiving and conditioning the raw laser beam into a collimated beam;

a first lens disposed downstream of the collimator and configured for conditioning the collimated beam and outputting an elongated oval laser beam;

a second lens disposed a distance downstream of the first lens and configured for receiving and collimating the oval laser beam;

a first triangular prism disposed downstream of the second lens and configured for receiving and bending the collimated oval laser beam; and a second triangular prism disposed a distance downstream of the first triangular prism and configured for receiving and correcting the bent collimated oval laser beam to output a substantially rectangular beam offset from a central axis of the optical assembly;

a rotational system coupled to the optical assembly and configured for rotating the laser beam about a central axis of the optical assembly;

a housing that contains at least a portion of the optical assembly, the housing being configured for movement within the wellbore to direct the laser beam relative to the wellbore;

a purging assembly disposed at least partially within or adjacent to the housing and configured for delivering a purging fluid to an area proximate the laser beam; and a control system to control at least one of the movement of the housing or an operation of the optical assembly to direct the laser beam within the wellbore.

2. The system of claim 1, where the distance between the first and second triangular prisms is adjustable.

3. The system of claim 2, where an adjustment mechanism changes the distance between the first triangular prism and the second triangular prism and the adjustment mechanism is controllable by the control system.

4. The system of claim 1, where the distance between the first and second lenses is adjustable.

5. The system of claim 4, where an adjustment mechanism changes the distance between the first lens and the second lens and the adjustment mechanism is controllable by the control system.

6. The system of claim 1, where at least one of the first or second lenses is a plano-concave lens.

7. The system of claim 1, where the rotational system is disposed upstream of the optical assembly and proximate or at least partially within the housing, the rotational system configured to rotate the optical assembly about the central axis.

8. The system of claim 1, where the rotational system is part of the purging system and comprises:

a generally cylindrical housing coupling a first portion and a second portion of the housing and defining at least one opening about a circumference of the circular housing;

a plurality of fins disposed at least partially within the at least one opening and spaced about the circumference of the circular housing; and at least one nozzle disposed within the circular housing and oriented offset from the central axis of the optical assembly, where the nozzle is configured to discharge a purging fluid at an angle towards the fins to cause rotational motion of the second portion of the housing.

9. The system of claim 8, where the rotational system further comprises a cover and at least one seal to isolate an internal space of the rotational assembly from a downhole environment of the wellbore.

10. The system of claim 1, where the rotational system is part of the purging system and comprises:

a generally cylindrical housing coupled to a first end of the housing and defining at least one opening about a circumference of the circular housing;

a plurality of fins disposed at least partially within the at least one opening and spaced about the circumference of the circular housing; and at least one nozzle disposed within the circular housing and oriented at an incline from the central axis of the optical assembly, where the nozzle is configured to discharge the purging fluid towards the fins to cause rotational motion of the housing.

11. The system of claim 1 further comprising one or more sensors to monitor one or more environmental conditions in the wellbore and to output signals based on the one or more environmental conditions to the control system.

12. The system of claim 1, further comprising a centralizer attached to the housing and configured to hold the tool in place relative to an outer casing in a wellbore.

13. A method of using a system for stimulating a hydrocarbon-bearing formation, the method comprising the steps of:

passing, through one or more optical transmission media, a raw laser beam generated by a laser generating unit at an origin of an optical path comprising the one or more optical transmission media;

delivering the raw laser beam to an optical assembly positioned within a wellbore; manipulating the raw laser beam with the optical assembly to output a substantially rectangular beam offset from a central axis of the optical assembly; and rotating the optical assembly about the central axis to rotate and deliver the substantially rectangular beam to the formation to drill a substantially circular hole in the formation, where a diameter of the hole is greater than a diameter of the raw laser beam.

14. The method of claim 13 further comprising the step of purging a path of the rotated laser beam with a purging nozzle during a period of a drilling operation.

15. The method of claim 14 further comprising the step of vacuuming any dust, vapor, or other debris generated during the drilling operation.

16. The method of claim 13, where the step of manipulating the raw laser beam with the optical assembly comprises the steps of:

collimating the raw laser beam in a collimator to create a collimated laser beam;

passing the collimated laser beam through a first lens to output an elongated oval laser beam;

passing the elongated oval laser beam through a second lens for collimating the elongated oval laser beam;

passing the collimated oval laser beam through a first triangular prism to bend the oval laser beam relative to the central axis of the optical assembly; and passing the bent laser beam through a second triangular prism to correct and output a substantially rectangular beam offset from the central axis of the optical assembly.

17. The method of claim 16, where the step of manipulating the raw laser beam includes adjusting a distance between the first and second triangular prisms to modify a distance the laser beam is offset from the central axis of the optical assembly.

18. The method of claim 16, where the step of manipulating the raw laser beam includes adjusting a distance between the first and second lenses to adjust a thickness of the collimated oval laser beam.

19. The method of claim 13 further comprising the steps of:

monitoring, using one or more sensors, one or more environmental conditions in the wellbore during operation of the tool; and outputting signals based on the one or more environmental conditions.

* * * * *